US009415600B2

(12) United States Patent
Derleth et al.

(10) Patent No.: US 9,415,600 B2
(45) Date of Patent: Aug. 16, 2016

(54) SYSTEM FOR DETECTING INOPERATIVE INKJETS IN THREE-DIMENSIONAL OBJECT PRINTING USING A DIGITAL CAMERA AND STROBE LIGHT

(71) Applicant: Xerox Corporation, Norwalk, CT (US)

(72) Inventors: David S. Derleth, Webster, NY (US); Frank B. Tamarez Gomez, Webster, NY (US); Matthew D. Savoy, Webster, NY (US); Annie Liu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 40 days.

(21) Appl. No.: 14/231,232

(22) Filed: Mar. 31, 2014

(65) Prior Publication Data

US 2015/0273912 A1 Oct. 1, 2015

(51) Int. Cl.

| | |
|---|---|
| ***B41J 29/393*** | (2006.01) |
| ***B41J 2/175*** | (2006.01) |
| ***B41J 2/165*** | (2006.01) |
| ***B41J 2/21*** | (2006.01) |
| ***B41J 29/02*** | (2006.01) |

(52) U.S. Cl.

CPC ..... *B41J 2/17509* (2013.01); *B41J 2/16579* (2013.01); *B41J 2/2142* (2013.01); *B41J 29/02* (2013.01)

(58) Field of Classification Search

CPC ..... B41J 29/393; B41J 29/02; B41J 2/2121; B41J 2/17509; B41J 2/16579; B41J 2/2142

USPC ..... 347/19

See application file for complete search history.

(56) References Cited

U.S. PATENT DOCUMENTS

| | | | | |
|---|---|---|---|---|
| 6,604,807 | B1 * | 8/2003 | Murcia et al. | 347/19 |
| 2002/0140757 | A1 * | 10/2002 | Tullis et al. | 347/19 |
| 2004/0012112 | A1 | 1/2004 | Davidson et al. | |
| 2004/0021724 | A1 * | 2/2004 | Kojima | 347/19 |
| 2004/0130585 | A1 * | 7/2004 | Weksler et al. | 347/12 |
| 2006/0111807 | A1 | 5/2006 | Gothait et al. | |
| 2006/0139392 | A1 * | 6/2006 | Fernandez et al. | 347/19 |
| 2006/0141145 | A1 | 6/2006 | Davidson et al. | |
| 2008/0037016 | A1 * | 2/2008 | Wong | B41J 2/125 356/335 |
| 2009/0011066 | A1 | 1/2009 | Davidson et al. | |
| 2009/0231368 | A1 * | 9/2009 | Nakano et al. | 347/8 |
| 2010/0151136 | A1 | 6/2010 | Davidson et al. | |

* cited by examiner

*Primary Examiner* — Stephen Meier
*Assistant Examiner* — Alexander D Shenderov
(74) *Attorney, Agent, or Firm* — Maginot Moore & Beck LLP

(57) ABSTRACT

An apparatus detects inoperative inkjets during printing of three-dimensional objects. The apparatus includes an optical sensor with a predetermined focal plane. The optical sensor is moved to a position that enables the sensor to generate image data of material drops ejected by a group of inkjets in a single row of a printhead. These image data are analyzed to detect inoperative inkjets to enable printhead maintenance at appropriate times to maintain the operational status of the inkjets in the printhead. The optical sensor is moved along a length and width of the printhead to enable the sensor to generate image data of all the inkjets that eject material from the printhead.

16 Claims, 6 Drawing Sheets

SYSTEM FOR DETECTING INOPERATIVE INKJETS IN THREE-DIMENSIONAL OBJECT PRINTING USING A DIGITAL CAMERA AND STROBE LIGHT

TECHNICAL FIELD

The device disclosed in this document relates to printers that produce three-dimensional objects and, more particularly, to the accurate detection of inoperative inkjets in such printers.

BACKGROUND

Digital three-dimensional manufacturing, also known as digital additive manufacturing, is a process of making a three-dimensional solid object from a digital model of virtually any shape. Three-dimensional printing is an additive process in which one or more printheads eject successive layers of material on a substrate in different shapes. Three-dimensional printing is distinguishable from traditional object-forming techniques, which mostly rely on the removal of material from a work piece by a subtractive process, such as cutting or drilling.

The production of a three-dimensional object with these printers can require hours or, with some objects, even days. One issue that arises in the production of three-dimensional objects with a three-dimensional printer is consistent functionality of the inkjets in the printheads that eject the drops of material that form the objects. During printing of an object, one or more inkjets can deteriorate by ejecting the material at an angle, rather than normal, to the printhead, ejecting drops that are smaller than an inkjet should eject, or by failing to eject any drop at all. An inkjet suffering from any of these operational deficiencies is known as an inoperative inkjet. If the operational status of one or more inkjets deteriorates during object printing, the quality of the printed object cannot be assessed until the printing operation is completed. Consequently, print jobs requiring many hours or multiple days can produce objects that do not conform to specifications due to inoperative inkjets in the printheads. Once such objects are detected, the printed objects are scrapped, restorative procedures are applied to the printheads to restore inkjet functionality, and the print job is repeated. An apparatus that enables detection of inoperative inkjets while printing would enable restorative procedures to be applied during object printing so a properly formed object can be produced. In this manner, product yield for the printer is improved and its printing is more efficient. The apparatus should be able to detect inoperative inkjets that eject a multitude of printing materials, such as clear, colored, translucent, phosphorescent, and waxy materials.

SUMMARY

An apparatus that enables inoperative inkjet detection in three-dimensional printers includes an optical sensor having a focal plane at a predetermined distance from the optical sensor, the optical sensor being configured to generate image data of the focal plane, an illumination source positioned to illuminate the focal plane of the optical sensor, and a controller operatively connected to the optical sensor, the controller being configured to operate a printhead positioned to eject drops from inkjets in the printhead into the focal plane of the optical sensor, to activate the illumination source as the printhead ejects drops into the focal plane of the optical sensor, and to receive image data of the focal plane from the optical sensor.

A printer that incorporates the apparatus for detecting inoperative inkjets includes a printhead configured for movement in a plane in two perpendicular directions in the plane, an optical sensor having a focal plane at a predetermined distance from the optical sensor, the optical sensor is positioned to enable the focal plane to be perpendicular to a face of the printhead and the plane in which the printhead is configured for movement, an illumination source positioned to illuminate the focal plane of the optical sensor, and a controller operatively connected to the printhead, the illumination source and the optical sensor, the controller being configured to operate the printhead to eject drops from inkjets in the printhead, to activate the illumination source as the printhead ejects drops through the focal plane of the optical sensor, and to receive image data of the drops passing through the focal plane of the optical sensor generated by the optical sensor.

BRIEF DESCRIPTION OF THE DRAWINGS

The foregoing aspects and other features of an apparatus or printer that detects inoperative inkjets during three-dimensional printing are explained in the following description, taken in connection with the accompanying drawings.

DETAILED DESCRIPTION

Figure 1:
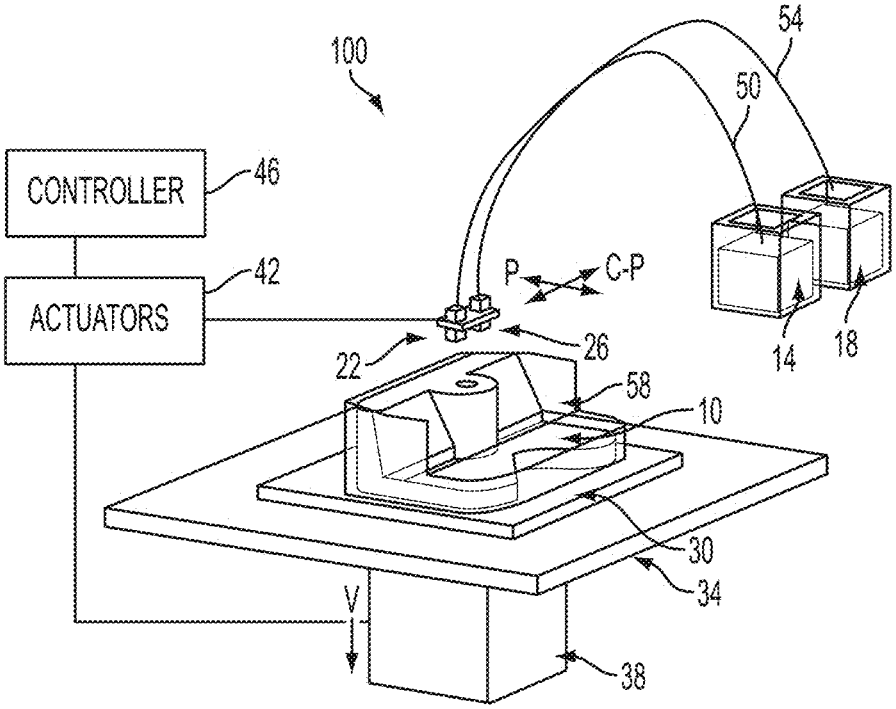
FIG. 1 is a perspective view of a three-dimensional object printer.

For a general understanding of the environment for the device disclosed herein as well as the details for the device, reference is made to the drawings. In the drawings, like reference numerals designate like elements.

FIG. 1 shows a configuration of components in a printer 100, which produces a three-dimensional object or part 10. As used in this document, the term "three-dimensional printer" refers to any device that ejects material with reference to image data of an object to form a three-dimensional object. The printer 100 includes a support material reservoir 14, a build material reservoir 18, a pair of inkjet printheads 22, 26, a build substrate 30, a planar support member 34, a columnar support member 38, an actuator 42, and a controller 46. Conduit 50 connects printhead 22 to support material reservoir 14 and conduit 54 connects printhead 26 to build material reservoir 18. Both inkjet printheads are operated by the controller 46 with reference to three-dimensional image data in a memory operatively connected to the controller to eject the support and build materials supplied to each respective printhead. The build material forms the structure of the part 10 being produced, while the support structure 58 formed by the support material enables the build material to maintain its shape while the material solidifies as the part is being constructed. After the part is finished, the support structure 58 is removed by washing, blowing, or melting.

The controller 46 is also operatively connected to at least one and possibly more actuators 42 to control movement of the planar support member 34, the columnar support member 38, and the printheads 22, 26 relative to one another. That is, one or more actuators can be operatively connected to structure supporting the printheads to move the printheads in a process direction and a cross-process direction with reference to the surface of the planar support member. Alternatively, one or more actuators can be operatively connected to the planar support member 34 to move the surface on which the part is being produced in the process and cross-process directions in the plane of the planar support member 34. As used herein, the term "process direction" refers to movement along one axis in the surface of the planar support member 34 and "cross-process direction" refers to movement along an axis in the planar support member surface that is orthogonal to the process direction axis in that surface. These directions are denoted with the letters "P" and "C-P" in FIG. 1. The printheads 22, 26 and the columnar support member 38 also move in a direction that is orthogonal to the planar support member 34. This direction is called the vertical direction in this document, is parallel to the columnar support member 38, and is denoted with the letter "V" in FIG. 1. Movement in the vertical direction is achieved with one or more actuators operatively connected to the columnar member 38, by one or more actuators operatively connected to the printheads 22, 26, or by one or more actuators operatively connected to both the columnar support member 38 and the printheads 22, 26. These actuators in these various configurations are operatively connected to the controller 46, which operates the actuators to move the columnar member 38, the printheads 22, 26, or both in the vertical direction.

Figure 2:
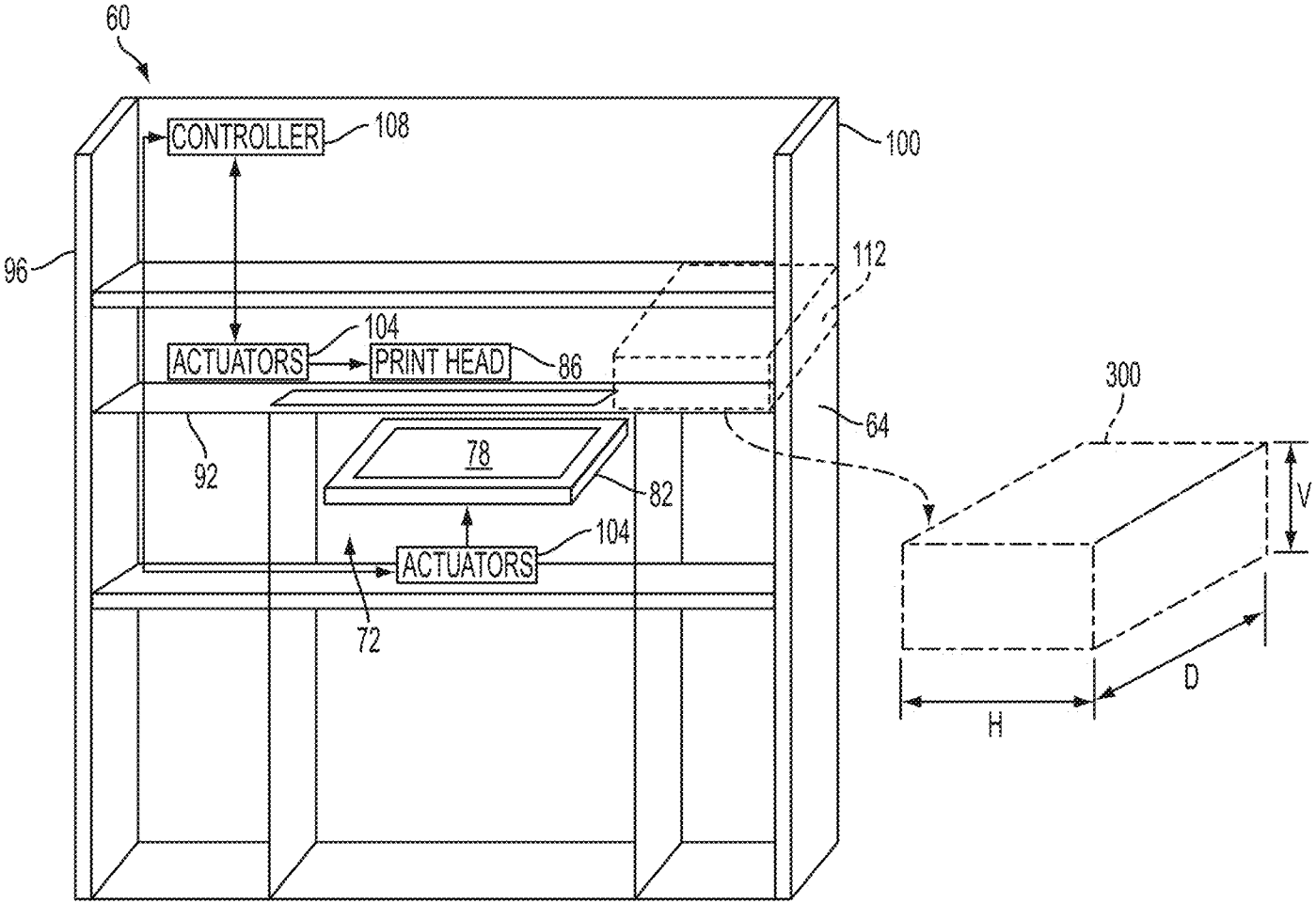
FIG. 2 is front view of a three-dimensional object printer having a housing that depicts a space within the housing for a module that enables inoperative inkjets in the printhead to be detected during a printing operation.

A three-dimensional object printer having a housing is shown in FIG. 2. That printer 60 has a housing 64. Within the housing 64 are six compartments that are generally cubic in shape. The housing 64 is shown in FIG. 2 without the doors that close to conceal the compartments. Compartment 72 includes a planar support 78 on a movable platform 82. Movable platform 82 is configured with one or more actuators and guide members (not shown) to enable the movable platform 82 to move up and down in a vertical direction. The planar support 78 is the surface on which a three-dimensional object is formed. In some embodiments, the printhead 86 has a length that is approximately equal to the length of the planar support 78 in the direction from the back wall of compartment 72 to the opening at the front of the compartment. In these embodiments, printhead 86 is mounted on support member 92 in the space between sidewalls 96 and 100 of housing 64 for linear reciprocating movement only. In other embodiments, the printhead 86 has a length that is less than the length of the planar support 78 in the direction from the back wall of compartment 72 to the opening at the front of the compartment. In these embodiments, printhead 86 is mounted on support member 92 in the space between sidewalls 96 and 100 of housing 64 for reciprocating movement in two orthogonal directions in a plane above compartment 72. In these various embodiments, one or more actuators 104 are operatively connected to the printhead 86. Controller 108 operates the actuators 104 to move the printhead 86 either linearly back and forth on support member 92 or to move the printhead in two orthogonal directions within a plane. By selectively operating the inkjets in the printhead 86, vertically moving the support platform 82, and horizontally moving the printhead 86 on the member 92, a three-dimensional object can be formed on the planar support 78.

The area 112 outlined in dashes in FIG. 2 identifies the placement of a module that uses a digital camera and light source to detect inoperative inkjets in the printer 60. As noted above, if an inkjet fails during printing of an object by either completely or partially failing to eject material or by errantly ejecting material in a skewed direction, the object being produced is malformed. Currently, this malformation cannot be detected until production of the object is finished. By using area 112 for optically imaging the material ejected from inkjets in the printhead 86, printer 60 can be configured to detect inoperative inkjets during object production as described more fully below. Some components within the module 300 can move in the horizontal direction H, depth direction D, and vertical direction V as shown in the figure.

Figure 3A:
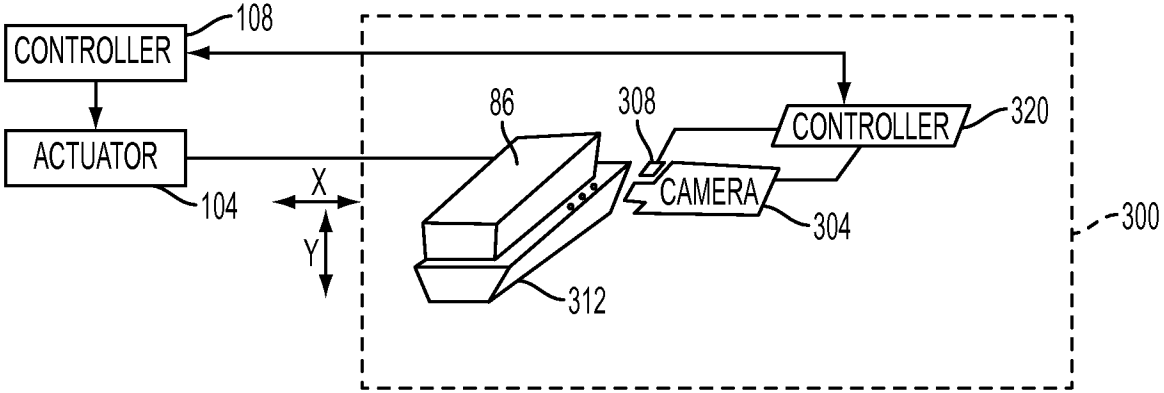
FIG. 3A is a perspective view of a module for detecting inoperative inkjets that fits in the space 112 shown in FIG. 2
Figure 3B:
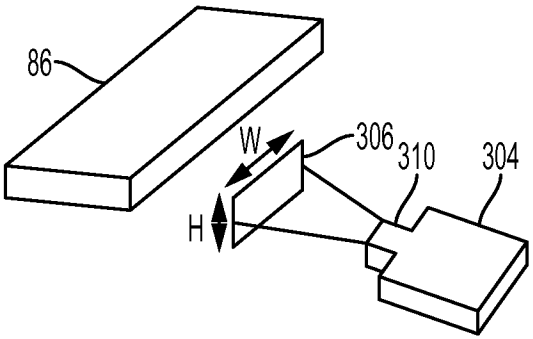
FIG. 3B depicts a position of the focal plane of the camera in a space beneath a printhead.
Figure 5:
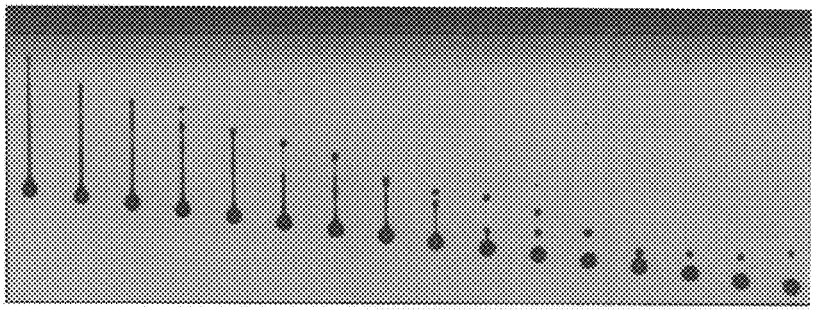
FIG. 5 is an illustration of material drops ejected by a printhead in the field of view of the camera shown in FIG. 3.

One embodiment of a module that detects inoperative inkjets during object printing is shown in the block diagram of FIG. 3A. The module 300 is configured to fit within area 112 of printer 60. The module 300 includes a high speed digital camera 304, a strobe light 308, a waste receptacle 312, and a controller 320. The controller is operatively connected to the camera 304, the strobe light 308, and the controller 108 that moves the printhead 86. The strobe light is tuned to produce illumination for a period of time that material drops are present in the field of view of the camera once the light is activated. The camera 304 has a focal plane 306 at a predetermined distance from the magnification lens 310 of the camera 304 as shown in FIG. 3B. The field of view of the camera also has a predetermined height H and width W. As explained below, the printhead 86 is maneuvered by the controller 108 to align a plane normal to the face of the printhead 86 with the focal plane 306 of the camera 304 at a distance from the printhead face that enables drops ejected from the inkjets in a row of the printhead 86 to pass through the focal plane 306 of the camera 304. Image data of the drops passing through the field of view of the camera 304 are captured and analyzed to identify inoperative inkjets (FIG. 5, for example).

Figure 4:
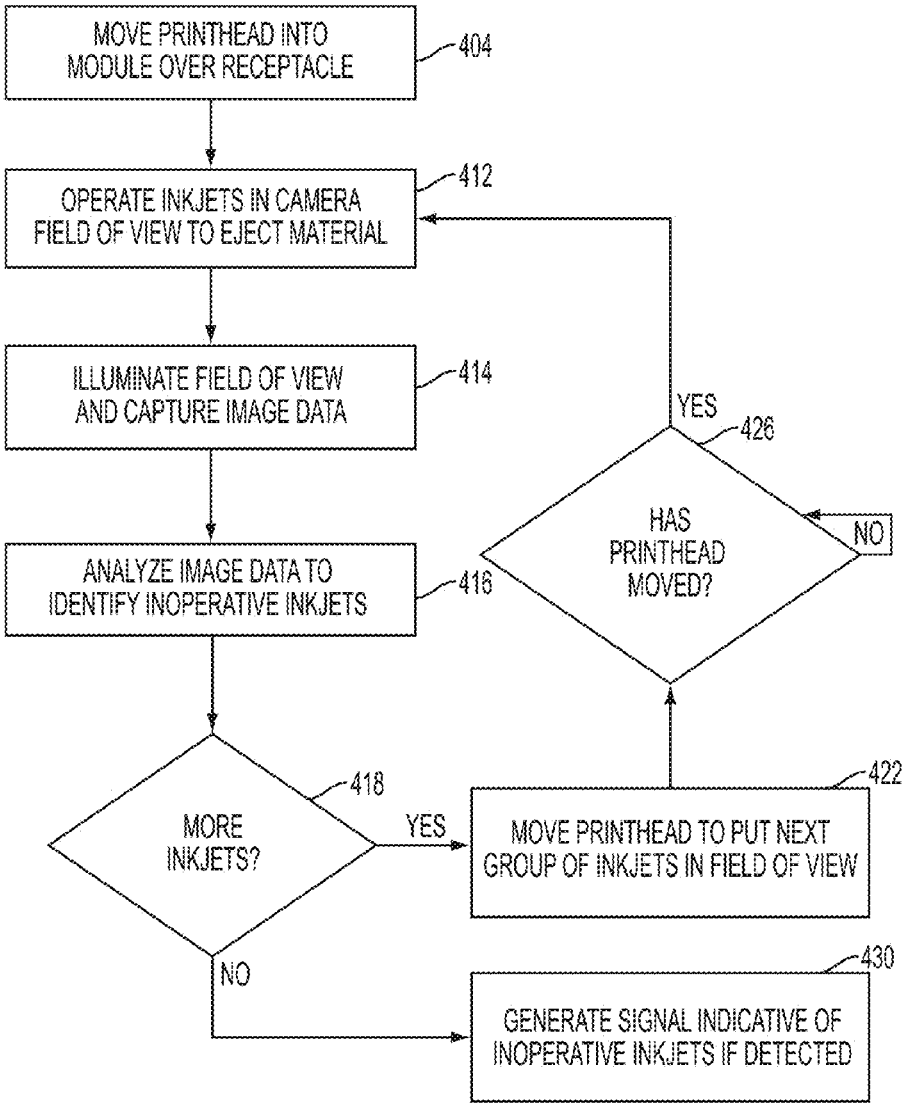
FIG. 4 is a flow diagram of a method for operating the module of FIG. 3.

To detect inoperative inkjets during printing operations, the module 300 is operated with reference to the method shown in FIG. 4. The method of FIG. 4 is implemented with controllers configured to perform the method. As used in this document, configuring a controller means storing programmed instructions in a memory operatively connected to the controller so when the controller executes the programmed instructions the controller generates signals to manipulate data and operate electronic components to perform the method.

Figure 6:
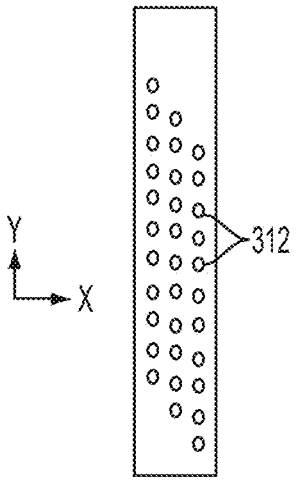
FIG. 6 is a perspective view of a printhead face that illustrates the X and Y directions of movement for imaging the ejections from inkjets in the printhead.

At predetermined times in the printing operation, the controller 108 (FIG. 2) operates an actuator 104 to move the printhead 86 into the module 300 located in the area 112 (block 404). In response to the controller 320 detecting the printhead in the module 300, controller 320 generates a signal to the controller 108 to operate some of the inkjets in the printhead to eject material (block 412). The controller 320 then operates the strobe light to illuminate the area beneath the printhead 86 and the camera is activated to generate image data of the illuminated area (block 414). The controller 320 analyzes the image data received from the camera to identify any inoperative inkjets (block 416). For example, the size of the drops in the image data can be measured and compared to an empirically determined drop size range to determine whether the drop mass/volume of the drops is within an acceptable range. Also, the time of travel for the drops across the field of view can be measured and compared to an empirically determined velocity range to determine whether an inkjet is firing correctly. Image data of material drops ejected from a group of inkjets in a staggered manner are shown in FIG. 5. Controller 320 checks to see if more inkjets are to be tested (block 418) and, if inkjets remain to be tested, generates electrical signals indicating an amount of movement for the printhead in an X or Y direction (block 422). The Y direction is movement along a row of inkjets and X direction is movement from one row in a printhead to another row in the printhead. This pattern of movement is shown in FIG. 6. In response to the controller 108 sending electrical signals to controller 320 that the printhead 86 has been moved (block 426), controller 320 generates the signals for controller 108 to operate the printhead (block 412), and then controller 320 activates the strobe light and the camera to capture image data of the material ejection (block 414). The process continues until all of the inkjets are tested (block 418). A list of the inoperative inkjets can be generated for the operator (block 430) so appropriate action can be taken.

One advantage of the module described is the ejection of the material drops into the waste receptacle 312. This configuration does not require substrates for the printing of a test pattern since the drops are imaged while they are in flight. The waste receptacle can be removed and either replaced or cleaned and then reinstalled from time to time to prevent the receptacle from overflowing.

In one embodiment, only a predetermined number of inkjets in a single row are operated. This predetermined number corresponds to the number of inkjets that can been seen in the field of view of the camera 304. The printhead can then be moved in the Y direction by a distance that corresponds to the width of the camera's field of vision. In this manner, all of the inkjets in a row of inkjets can be successively imaged as they eject material. Any inkjet that does not produce a drop of the material in the field of view is identified as being inoperative. After a row of inkjets have been operated and imaged, the printhead can be moved in the X direction to transition to a new row and the inkjets in this row successively imaged until all the inkjets in that row have been imaged as they eject material. This process is repeated until all of the rows of inkjets have been tested. Alternatively, a corresponding section of each row can be imaged successively by moving the printhead in the X direction and then moving the printhead in the Y direction by a distance corresponding to the width of the field of vision of the camera before successively imaging a portion in each row. This type of pattern can be repeated until all of the inkjets have been tested. Alternatively, other combinations of X and Y direction movement can be used to test all of the inkjets in a printhead.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A printer comprising:

a printhead configured to eject drops of material;

a planar support positioned to receive drops of material ejected from the printhead;

a receptacle;

at least one actuator operatively connected to the printhead, the at least one actuator being configured to move the printhead between a first position where the planar support receives drops of material ejected by the printhead and a second position where the receptacle receives drops of material ejected by the printhead, and to move the printhead in two perpendicular directions in a plane parallel to a face of the printhead when the printhead is at the second position;

an optical sensor having a focal plane at a predetermined distance from the optical sensor, the optical sensor is positioned to enable the focal plane to be perpendicular to the face of the printhead when the printhead is at the second position and to the plane in which the printhead is configured for movement in the two perpendicular directions;

a strobe light positioned to illuminate the focal plane of the optical sensor; and a controller operatively connected to the at least one actuator, the printhead, the strobe light and the optical sensor, the controller being configured to operate the at least one actuator to move the printhead from the first position to the second position, to operate the printhead to eject drops of material from inkjets in the printhead into the receptacle, to activate the strobe light as the controller initiates operation of the printhead to eject drops of material through the focal plane of the optical sensor into the receptacle to enable the strobe light to operate at a frequency at which the controller operates inkjets within the printhead, to receive image data of the drops passing through the focal plane of the optical sensor generated by the optical sensor, and to operate the at least one actuator to move the printhead in the two perpendicular directions in the plane parallel to the face of the printhead when the printhead is at the second position, and to move the printhead from the second position to the first position.

2. The printer of claim 1, the controller being further configured to detect an absence of drops at predetermined positions in the image data received from the optical sensor to identify inoperative inkjets in the printhead.

3. The printer of claim 1, the controller being further configured to identify a volume of each drop depicted in the image data received from the optical sensor to identify inkjets in the printhead that are ejecting drops less than a predetermined size.

4. The printer of claim 1, the controller being further configured to identify a velocity of each drop depicted in the image data received from the optical sensor to identify inkjets in the printhead that are ejecting drops less than a predetermined velocity.

5. The printer of claim 1 wherein the inkjets ejecting the drops through the focal plane of the optical sensor are a first group of inkjets in the printhead, the first group of inkjets having fewer inkjets than a total number of inkjets in the printhead.

6. The printer of claim 5, the controller being further configured to operate the at least one actuator when the printhead is at the second position to move the printhead in one of the two perpendicular directions to enable drops ejected by a second group of inkjets in the printhead to pass through the focal plane of the optical sensor, the second group of inkjets being different from the first group of inkjets.

7. The printer of claim 6, the controller being further configured to operate the at least one actuator to move the printhead when the printhead is at the second position in the other of the two perpendicular directions to enable drops ejected by a third group of inkjets in the printhead to pass through the focal plane of the optical sensor, the third group of inkjets being different from the first group of inkjets and the second group of inkjets.

8. The printer of claim 1 wherein the optical sensor is a digital camera having a magnification lens.

9. An apparatus for detecting inoperable inkjets in a printer comprising:

an optical sensor having a focal plane at a predetermined distance from the optical sensor, the optical sensor being configured to generate image data of the focal plane;

a strobe light positioned to illuminate the focal plane of the optical sensor;

a receptacle; and a controller operatively connected to the optical sensor, the controller being configured to detect a printhead within the apparatus, to operate the printhead positioned within the apparatus to eject drops from inkjets in the printhead through the focal plane of the optical sensor into the receptacle, to activate the strobe light as the controller initiates operation of the printhead to eject drops through the focal plane of the optical sensor to enable the strobe light to operate at a frequency at which the controller operates inkjets within the printhead, and to receive image data of the focal plane from the optical sensor.

10. The apparatus of claim 9, the controller being further configured to detect an absence of drops at predetermined positions in the image data received from the optical sensor to identify inoperative inkjets in the printhead.

11. The apparatus of claim 9, the controller being further configured to identify a volume of each drop depicted in the image data received from the optical sensor to identify inkjets in the printhead that are ejecting drops less than a predetermined size.

12. The apparatus of claim 9, the controller being further configured to identify a velocity of each drop depicted in the image data received from the optical sensor to identify inkjets in the printhead that are ejecting drops less than a predetermined velocity.

13. The apparatus of claim 9 wherein the optical sensor is configured with a field of view having a size that enables a first group of inkjets in the printhead to be imaged in the focal plane, the first group of inkjets having fewer inkjets that a total number of inkjets in the printhead.

14. The apparatus of claim 13, the controller being further configured to generate signals for moving the printhead in one of two perpendicular directions in a plane to enable drops ejected by a second group of inkjets in the printhead to pass through the field of view of the optical sensor, the second group of inkjets being different from the first group of inkjets.

15. The apparatus of claim 14, the controller being further configured to generate signals for moving the printhead in the other of the two perpendicular directions to enable drops ejected by a third group of inkjets in the printhead to pass through the field of view of the optical sensor, the third group of inkjets being different from the first group of inkjets and the second group of inkjets.

16. The apparatus of claim 9 wherein the optical sensor is a digital camera having a magnification lens.

* * * * *